United States Patent [19]

Kleefeldt

[11] Patent Number: 4,869,536

[45] Date of Patent: Sep. 26, 1989

[54] VEHICLE DOOR LATCH WITH SECONDARY FORK

[75] Inventor: Frank Kleefeldt, Heiligenhaus, Fed. Rep. of Germany

[73] Assignee: Kiekert GmbH & Co. Kommanditgesellschaft, Heiligenhaus, Fed. Rep. of Germany

[21] Appl. No.: 218,237

[22] Filed: Jul. 12, 1988

[30] Foreign Application Priority Data

Jul. 29, 1987 [DE] Fed. Rep. of Germany ..... 3725074

[51] Int. Cl.[4] ..... E05C 3/04

[52] U.S. Cl. ..... 292/210; 292/216; 292/341.12; 292/DIG. 56; 292/DIG. 73

[58] Field of Search ..... 292/216, DIG. 56, DIG. 23, 292/DIG. 38, DIG. 73, DIG. 40, DIG. 60, 198, 210, 220, 341.12, 341.13

[56] References Cited

U.S. PATENT DOCUMENTS

| | | | |
|---|---|---|---|
| H358 | 11/1987 | Kaveney, Jr. | 292/DIG. 73 |
| 3,206,240 | 9/1965 | Roethel | 292/216 |
| 3,367,699 | 2/1968 | Leslie | 292/216 |
| 3,380,771 | 4/1968 | Rogers, Jr. | 292/216 X |
| 3,394,956 | 7/1968 | Zaydel | 292/216 X |
| 3,409,321 | 11/1968 | Wolfslayer | 292/216 |
| 3,523,704 | 8/1970 | Sandor | 292/216 |
| 3,545,800 | 12/1970 | Livonia | 292/216 |
| 3,844,593 | 10/1974 | Slattery | 292/216 X |
| 4,235,462 | 11/1980 | Torii et al. | 292/216 |
| 4,358,141 | 11/1982 | Hamada | 292/DIG. 38 X |
| 4,364,590 | 12/1982 | Hamada | 292/216 X |
| 4,452,058 | 6/1984 | Noel | 292/216 X |
| 4,538,845 | 9/1985 | Yamada | 292/DIG. 38 X |
| 4,643,470 | 2/1987 | Kazuyuki et al. | 272/DIG. 73 X |
| 4,775,176 | 10/1988 | Ikeda | 292/DIG. 38 X |

*Primary Examiner*—Gary L. Smith
*Assistant Examiner*—Michael J. Milano
*Attorney, Agent, or Firm*—Herbert Dubno; Andrew Wilford

[57] ABSTRACT

A vehicle door latch for use in combination with a door bolt has a housing formed with a horizontally open recess in which the bolt is receivable, a latch fork formed with a fork seat, and a fork pivot to one vertical side of the recess on the housing supporting the fork for pivoting between a locked position with the seal directed vertically away from the fork pivot and the bolt engaged in the seat and an unlocked position permitting the bolt to enter and exit seat and recess. A latch pawl is pivotal on the housing into and out of a position retaining the fork in the locked position. A retaining dog formed with a dog seat is carried on a dog pivot to the vertical side of the recess on the housing opposite the fork pivot for pivoting between a retaining position with the dog seat directed vertically away from the dog pivot and the bolt engaged in the dog seat as well as in the fork seat, and a freeing position permitting the bolt to enter and exit the recess. The bolt is therefore vertically embraced between the fork and dog seats in the locked position.

3 Claims, 1 Drawing Sheet

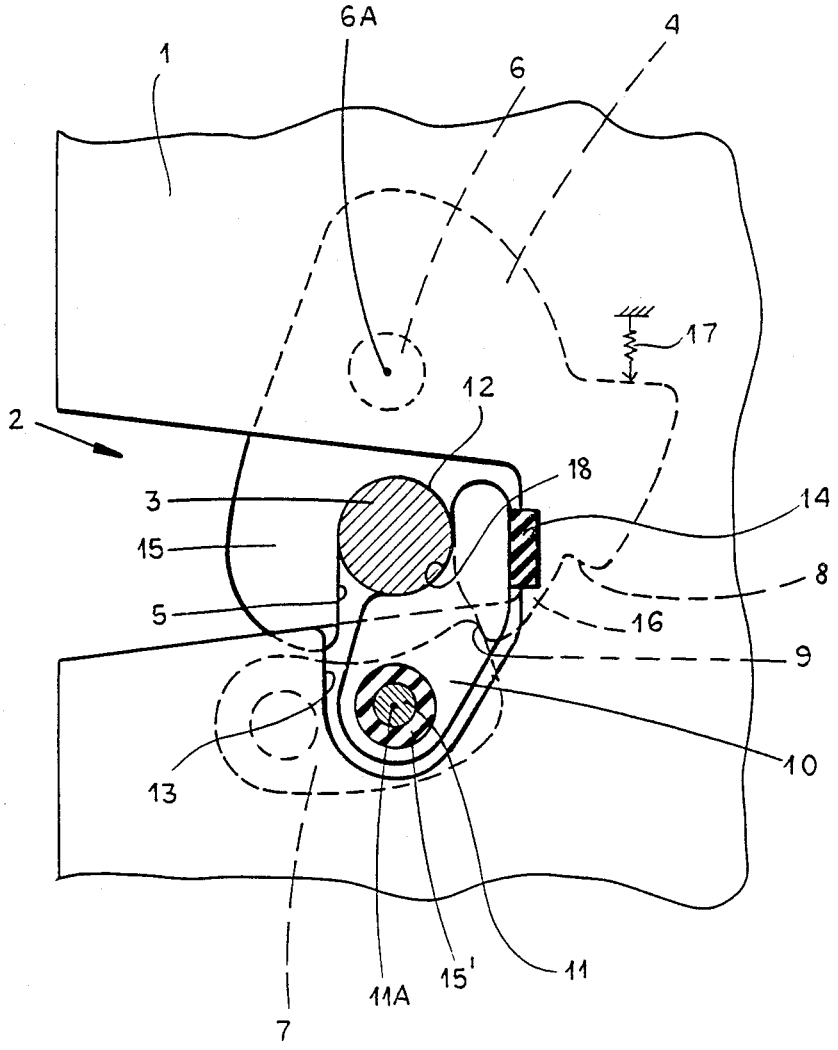
6A
4
1
6
17
12
2
18
3
14
15
8
5
16
9
10
13
11
15'
11A
7

VEHICLE DOOR LATCH WITH SECONDARY FORK

FIELD OF THE INVENTION

The present invention relates to a door latch for a motor vehicle. More particularly this invention concerns a door latch carried on a door and cooperating with a bolt mounted on a door post.

BACKGROUND OF THE INVENTION

A standard motor-vehicle door latch mounted on an outer door edge has latching mechanism comprised mainly of a fork that can in a locked position engage around a jamb-mounted bolt and hold the door closed, and that can in an unlocked position release this bolt. The latching mechanism also normally has a pawl that is used to block the fork in the locked position, the fork being spring-loaded to move into the unlocked position when released by this pawl.

Typically the fork has an outer arm and an inner arm forming a retaining seat between themselves. The fork is oriented in a vertical plane with the two arms pointing down and the seat also open down. The pivot axis is of course above the seat and between an upward extension of the arms so that the fork pivots between a downwardly and outwardly open position when open and a downwardly and inwardly open position when closed. In the locked position it engages downward over the bolt, normally with same fitting solidly in the seat between the fork arms. The latch is enclosed in a housing formed with a notch at which the seat between the fork arms is exposed in all positions, and the bolt has an enlarged head wider than the notch. In the locked position outward movement of the bolt is limited by the outer arm of the fork, upward movement by engagement with the seat of the fork, inward movement by the interfit of the door and post, and downward movement by the lower edge of the notch of the latch housing.

It is therefore standard to fit the door to the vehicle such that the bolt bears upward with some slight force on the fork in the locked position. Thus elastic deformation of the parts constitutes a prestressing action keeping the bolt snug in the latch when the door is locked. Even if the bolt is a little high, this only makes it a particularly tight fit, but still lets the door close and latch properly. When a little low. However, the bolt will not contact the downwardly directed surface of the seat between the fork arms and will likely move vertically somewhat as the car hits bumps. The resultant rattel not only is annoying, but can be indicative of considerable wear taking place.

OBJECTS OF THE INVENTION

It is therefore an object of the present invention to provide an improved motor-vehicle door latch.

Another object is the provision of such a motor-vehicle door latch which overcomes the above-given disadvantages, that is which locks snugly and that accepts substantial misalignment between the latch bolt and the fork.

SUMMARY OF THE INVENTION

A vehicle door latch for use in combination with a door bolt according to this invention has a housing formed with a horizontally open recess in which the bolt is receivable, a latch fork formed with a fork seat, and a fork pivot to one vertical side of the recess on the housing supporting the fork for pivoting between a locked position with the seat directed vertically away from the fork pivot and the bolt engaged in the seat and an unlocked position permitting the bolt to enter and exit the seat and recess. A latch pawl is pivotal on the housing into and out of a position retaining the fork in the locked position. A retaining dog formed with a dog seat is carried on a dog pivot to the vertical side of the recess on the housing opposite the fork pivot for pivoting between a retaining position with the dog seat directed vertically away from the dog pivot and the bolt engaged in the dog seat as well as in the fork seat, and a freeing position permitting the bolt to enter and exit the recess. The bolt is therefore vertically embraced between the fork and dog seats in the locked position.

According to this invention therefore as the bolt moves into the latch it engages both of the seats and, as necessary, is pushed down by the seat of the fork or up by the seat of the dog to end in an exactly aligned and centered position. Thus the lock of this invention can compensate for a door set too low as well as one set too high. An advantage of this is that the standard overcompensation of setting the door too high need no longer be done; instead the door is set as close as possible on center.

The mechanism of this invention is essentially passive. The dog need not be connected to the latch mechanism at all so that it adds nothing significant to the cost of the latch incorporating it. On the other hand it ensures accurate closing and holding of the door and will surely eliminate rattling.

According to another feature of this invention the dog is pivotal between an inner position corresponding to the retaining position and an outer position corresponding to the locked position and the housing is provided with respective inner and outer abutments engageable with the dog in the respective positions. Moreover, the inner abutment against which the dog lies in the locked position is provided with an elastic bumper engaging the dog. The dog pivot carries a resilient sleeve in turn carrying the dog.

In accordance with this invention the pivots are vertically aligned and vertically flank the recess. The fork pivot is above the recess and the dog pivot below it.

DESCRIPTION OF THE DRAWING

The above and other objects, features, and advantages will become more apparent from the following, reference being made to the accompanying drawing whose sole figure is a vertical section through the latch according to this invention.

SPECIFIC DESCRIPTION

As seen in the drawing a vehicle door latch usable on any style of motor vehicle has a housing 1 formed with a horizontally and outwardly open notch or cutout 2 into which the bolt 3 can engage and carries a standard lock fork 4 pivoted on a pin 6 centered on an axis 6A and formed offset from this axis 6A with a radially and downwardly open seat 12 defined between an outer leg 15 and an inner leg 16. A lock pawl 7 can engage against either of two detents 8 or 9 of the fork 4 in the manner well known in the art to retain it against the force of a spring 17 in a partially or fully locked position, thereby capturing and retaining the bolt 3. As described above, the bolt 3, as it enters the notch or recess 2, engages the inner leg 16 and rotates the fork 4 back into the illustrated position, with this bolt 4 coming to rest in the seat 12 formed between the two arms 15 and 16. This structure is all standard.

According to this invention the lock housing 1 is provided with a pivot pin 11 centered on an axis 11A carrying via an elastic sleeve 15 a retaining dog 10 formed with a seat 18 of the same radius of curvature as the seat 12 which is the same radius as the outside surface of the bolt 3. The axis 11A is directly below the center of the bolt 3 in the closed position and the axis 6A directly above it, and the two seats 12 and 18 are concentric and engage the bolt respectively downward and upward. In addition the inner end of the notch 2 is provided with a bumper 14 that engages the inner surface of the dog 10 and the housing 1 is also formed with a stop 13 that limits outward pivoting of the dog 10.

Thus according top this invention as the bolt 3 moves into the notch 2 it not only engages the arm 16 and pivots the fork 4 counterclockwise, it also engages in the opposite seat 18 of the dog 10 and rotates it clockwise until it comes to rest against the elastic bumper 14. In this position the bolt 3 is effectively and snugly embraced between the seat 12 of the fork 3 and the seat 18 of the dog 10. The positions of the two pivots 6 and 11 are such that the bolt 3 is thus held solidly with modest compression of the sleeve 15. In this manner if the door carrying the bolt 3 is set a little to high or a little too low, the respective seat 12 or 18 will push the bolt 3 into the desired position.

Since the dog 10 is a wholly passive element which can at most be urged rotationally counterclockwise by a torque spring it adds very little to the cost of the latch it is provided on. At the same time it surely and accurately embraces the bolt both from the top and from the bottom to compensate for minor up-and-down misalignments between the door and the latch.

I claim:

1. A vehicle door latch for use in combination with a door bolt, the latch comprising:

a housing formed with a horizontally open recess in which the bolt is receivable;

a latch fork formed with a fork seat;

a fork pivot to one vertical side of the recess on the housing supporting the fork for pivoting between a locked position with the seat directed vertically away from the fork pivot and the bolt engaged in the seat and an unlocked position permitting the bolt to enter and exit the seat and the recess;

a latch pawl pivotal on the housing into and out of a position retaining the fork in the locked position;

a retaining dog formed with a dog seat;

a dog pivot to the vertical side of the recess on the housing opposite the fork pivot and supporting the dog for pivoting between an inner retaining position with the dog seat directed vertically away from the dog pivot and the bolt engaged in the dog seat as well as in the fork seat, and an outer freeing position permitting the bolt to enter and exit the recess, the bolt being vertically embraced between the fork and dog seats in the locked position, the fork pivot and the dog pivot vertically flanking the fork and dog seats in the locked and retaining positions thereof;

an outer abutment on the housing engaging the dog only in the outer freeing position thereof; and an elastic bumper fixed on the housing at the base of the notch and forming an inner abutment against which the dog rests only in the inner retaining position thereof, whereby in the locked and retaining position the bolt bears upward via the fork and fork pivot on the housing, downward via the dog and dog pivot on the housing, inward via the dog and bumper on the housing, and outward via the fork and pawl on the housing.

2. The latch defined in claim 1 wherein the dog pivot carries a resilient sleeve in turn carrying the dog.

3. The latch defined in claim 1 wherein the fork pivot is above the recess and the dog pivot below it.

* * * * *